United States Patent [19]

Habegger

[11] 3,972,213

[45] Aug. 3, 1976

[54] THREAD-ROLLING HEAD

[76] Inventor: Harold Habegger, Sous Graitery 10, 2738 Court, Bern, Switzerland

[22] Filed: July 31, 1975

[21] Appl. No.: 600,811

[30] Foreign Application Priority Data

Aug. 6, 1974 Switzerland ..... 10745/74

[52] U.S. Cl. ..... 72/104; 72/108; 72/121; 10/89 H

[51] Int. Cl.[2] ..... B21H 3/04

[58] Field of Search ..... 72/104, 108, 121; 10/89 H, 96 R, 100; 408/148

[56] References Cited

UNITED STATES PATENTS

| | | | |
|---|---|---|---|
| 2,376,727 | 5/1945 | Schutte | 10/89 H |
| 3,352,139 | 11/1967 | Cummings | 72/121 |
| 3,452,567 | 7/1969 | Marcovitch | 72/121 |
| 3,681,802 | 8/1972 | Youtz et al. | 72/104 |

*Primary Examiner*—Lowell A. Larson
*Attorney, Agent, or Firm*—McNenny, Pearne, Gordon, Gail, Dickinson & Schiller

[57] ABSTRACT

A thread-rolling head comprises three crank-like support pieces, each bearing a thread roller, protruding from a support member in which they are mounted. A control member is held unrotatably on the support member while a bearing member held in front of the support member is rotatable and stop means are operative between the bearing and the support member to transmit to the latter a torque received from the workpiece through the thread rollers; the stop means is rendered inoperative when the bearing means is caused by the workpiece to move forwardly, whereby the torque will aid a spring in rotating the bearing member to pivot the support pieces in order to remove the thread rollers from the workpiece.

7 Claims, 8 Drawing Figures

VI
VII
VI
VII
1
2
2a
2b
3
3a
4
4a
4b
4c
5
6
6a
7
8
9
10
11
12
13
14
15
16
17
19
20
20a
21
22
23
24
25

2
3
4
4a
4b
4c
9
10
12
13
14
15
18
22
26

VIII
VIII
1
2
2b
3
3a
4
4a
4b
4c
5
6
8
9
10
11
13
14
16
17
19
20
20a
21
22
26

2
3
4
4a
4b
4c
9
10
12
13
14
15
18
22
26

THREAD-ROLLING HEAD

This invention relates to a thread-rolling head for processing a workpiece and comprising a support member, a bearing member held in front of the support member, and having an axis in common therewith, three crank-like support pieces identical to one another and each having a pivot pin, a supporting journal, and a cheek, three bearing bores made in the bearing member and distributed about said common axis, each pivot pin being situated in a respective bearing bore, three thread rollers, each thread roller being borne by a respective supporting journal, a control member coaxially surrounding the bearing member and having an inner flange, the inner side of the flange forming a control surface, each cheek resting against a respective section of the control surface, stop means disposed on the support member and on the bearing member, and a spring disposed within the support member, the control surface being so designed that a relative rotation between the bearing member and the control member causes a uniform pivoting of the support pieces away from one another and the stop means being adapted either to engage with one another and thereby to prevent the relative rotation or to disengage from one another and thereby to enable the spring to bring about the relative rotation.

Thread-rolling heads are tools which are used particularly on turret lathes and by means of which a screw thread can be produced on a workpiece by a rolling operation instead of by a cutting operation. Examples of older designs of thread-rolling heads are described in Swiss Pat. Nos. 389,550 and 346,515 and in German Pat. No. 1,092,870. The thread-rolling head to which this invention relates is of a newer kind, as initially described and as already available on the market. It represents an improvement over the older construction in that when the control member runs up against an outer or inner stop, it undergoes a longitudinal displacement, by means of which the stop means become inoperative. The spring which then brings about the relative rotation acts upon the control member and must be a very strong one because there is a great deal of friction between the control surface and the individual support pieces. This entails various disadvantages. Among other things, the support pieces and a number of other parts must be very large-sized, which leads to a large-diameter construction and also results in a certain sluggishness of response. A great force must be overcome in order to clamp the control member against the action of the spring in order to engage the stop means. Then, too, a considerable amount of friction acts in turn upon the latter; this constitutes a hindrance to easy releasing of the stop means and can result in belated "opening" of the thread-rolling head.

It is the object of this invention to provide a thread-rolling head which eliminates these drawbacks of the prior art designs.

The basic idea underlying the present invention is to make use of the torque exerted by the workpiece on the bearing member via the thread rollers and the support pieces in order to rotate the bearing member, together with the support pieces, relative to the control member after the stop means have been released, so as to bring about the opening of the rolling head. Hence this torque is utilized to overcome the friction, which is especially great at the beginning of opening, between the support pieces and the control member; the spring need then merely carry out the remainder of the rotation of the bearing member and may therefore be quite a weak spring.

The aforementioned object of the present invention is achieved in that the control member is held unrotatingly on the support member whereas the bearing member is held rotatingly, the stop means being operative between the bearing member and the support member in such a way that during operation, the stop means transmit to the support member a torque transmitted from the workpiece to the bearing member via the thread rollers, a forward displacement of the bearing member relative to the support member caused by said workpiece rendering the stop means inoperative, and the torque, temporarily still acting upon the bearing member, aiding the spring in rotating the bearing member for enabling the pivoting of the support pieces away from one another.

One of the results achieved by means of such a design is that the thread-rolling head responds quite sensitively to cessation of the feed and thereupon automatically opens at once because the bearing member is immediately drawn away from the support member via the thread rollers and the support pieces, which causes the stop means to be released immediately when the mechanism is designed accordingly. The bearing member is then rotated with respect to the control member, by the aforementioned torque transmitted to the bearing member, in the direction tending to open the rolling head, i.e., to swivel the parts of the support pieces bearing the rollers away from the workpiece.

Now since a very weak spring is sufficient to carry out the remainder of the rotation of the bearing member, this spring can easily be accomodated inside the thread-rolling head, and in the case of manual clamping, only a slight force need be overcome by the operator. A number of parts may be made smaller in size, and as a result, the outside diameter of the rolling head is reduced for a given nominal diameter (diameter of the workpiece). Furthermore, there is also less wear on various supporting surfaces.

In a preferred embodiment, provision may be made for the thread rollers to be disposed in front of the inner flange of the control member on the supporting journals of the associated support pieces. These supporting journals are cantilevered, and the thread rollers are secured thereon against forward displacement, e.g., by circlips.

By means of such a design, the thread rollers are situated all the way to the front of the thread-rolling head, and thus a thread can be rolled on a workpiece up to very close to a stepped portion, e.g., very close to a screw head.

Provision may further be made for each pivot pin of the support pieces to have a recess, which is segmentally shaped when viewed in axial direction, in the rearward end of the pivot pin which projects out of the bearing member, and a single annular spring may be provided which acts upon the pivot pins in the region of these recesses for holding the cheeks of the support pieces against the control surface of the control member. This obviously results in great simplicity of the means, viz., the single annular spring, necessary to hold these cheeks against that control surface.

In such a design, provision may also expediently be made for the bottom of each recess to be rearwardly inclined at an angle of about 30° to the axis of the respective pivot pin. With such a design, a further simplification and reduction in cost of the construction is achieved in that the annular spring also serves to secure the support pieces longitudinally on the bearing member. Still a further simplification may be accomplished by using a spiral spring as the spring which is operative after the disengagement of the stop means and by accommodating this spiral in a bore of a shaft forming part of the support member. Besides its torsional effect, this spring also exerts a traction effect upon a portion of a shaft of the bearing member which is rotatingly and slidingly mounted in the aforementioned bore.

In this embodiment, therefore, the torsion spring serves simultaneously as a traction spring which pulls the bearing member, together with the support pieces and the control member, back against the support member and causes the stop means to engage with one another at the end of the clamping operation.

The stop means preferably consist of claws formed partly on the front end face of the support member and partly on the periphery of the bearing member shaft.

In addition, provision may be made for the support member shaft to have at its front end an exterior flange, against the rear side of which lies a first disc, disposed basically rotatingly on the shaft, in which disc there is eccentrically secured a bolt positioned parallel to the axis of the shaft, which bolt engages substantially without radial play in an elongated slot in the control member. Between this first disc and a second disc, which is clamped fast on the support member shaft just behind the first disc, a device is operative which enables a rotational adjustment of the first disc together with the control member.

Such a design makes it possible, particularly during assembly, to set exactly the correct rotational position of the control member with respect to the bearing member and the support pieces; it also enables the diameter of the thread produced on the workpiece to be varied within tolerance limitations.

A preferred embodiment of the invention will now be described in detail with reference to the accompanying drawings, in which.

Figure 1:
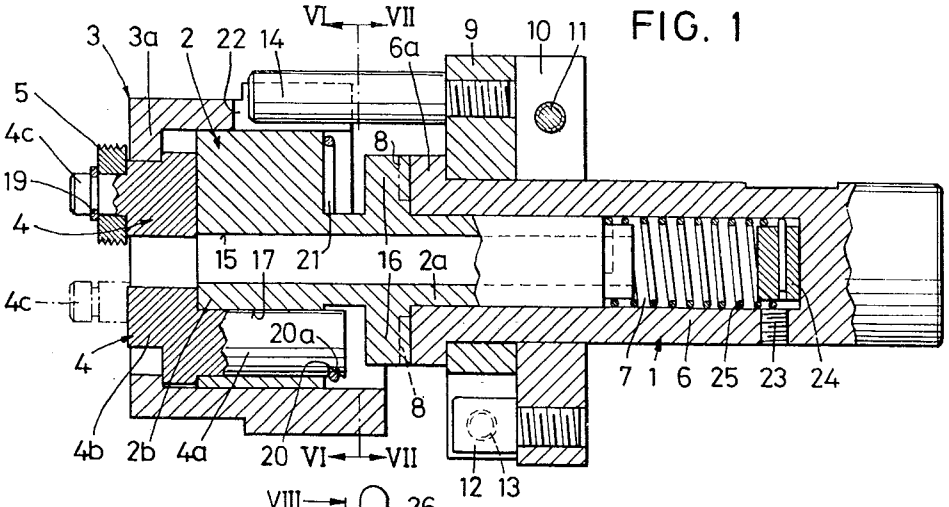
FIGS. 1 and 2 are a longitudinal section and an end-on view, respectively, of the thread-rolling head, the parts being shown in the position which they assume when the thread rollers are in working position, i.e., when the thread-rolling head is "closed,"

The main parts or groups of components of the thread-rolling head shown in the drawings are a support member 1, a bearing member 2, a control member 3, three support pieces 4, and three thread rollers 5.

The support member 1 comprises a shaft 6 which is intended to be clamped in a turret of an automatic lathe, for example. The shaft 6 has a blind-end bore 7 opening out towards the front and, at the front, a flange

Figure 7:
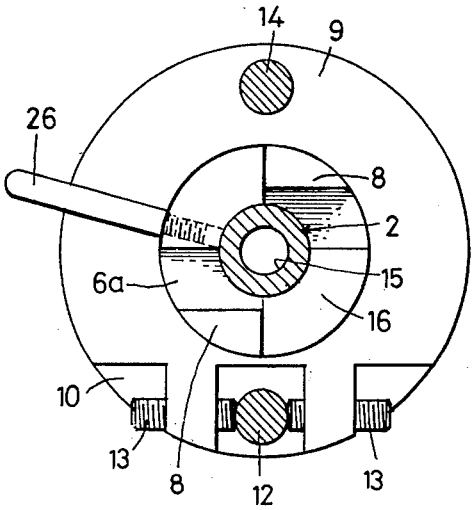
Figure 8:
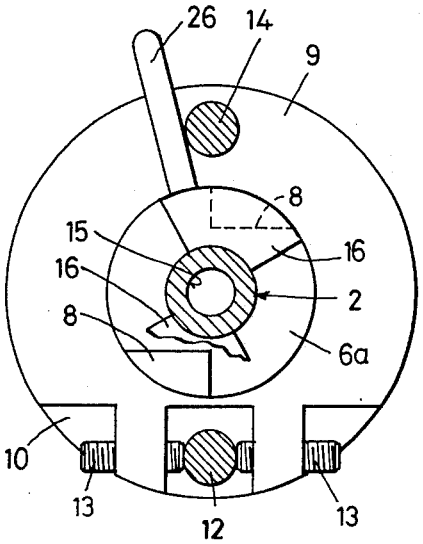

6*a*, on the front of which two claws 8, forming part of stop means, are disposed symmetrically to the axis thereof (cf. FIGS. 7 and 8). A first disc 9 is basically rotatingly disposed on the shaft 6 just behind the flange 6*a*, and a radially-slotted second disc 10 is clamped fast on the shaft 6 by a screw 11. A device comprising a bolt 12 snugly fitted in the second disc 10 and two headless screws 13 adjustable in the first disc 9 enables a certain rotational adjustment of the disc 9 relative to the disc 10 for purposes which will be explained further on. A forwardly-projecting bolt 14 is snugly fitted in an off-center taphole of the disc 9, parallel to the axis thereof.

The bearing member 2 has a continuous central longitudinal bore 15 which, during operation of the thread-rolling head, receives a longer or shorter section of the workpiece. The rearward end portion of a hollow cylindrical shaft 2*a* of the bearing member 2 is rotatingly and slidingly mounted in the blind-end bore 7 of the shaft 2*a*, two claws 16 are disposed symmetrically to the axis thereof; the claws 16 also form part of stop means and cooperate with the claws 8. The bearing member 2 has a solid head portion 2*b* at its extreme front end. The head portion 2*b* has three bearing bores 17 uniformly distributed circumferentially and identically spaced from the main axis; in each of the bearing bores 17, a pivot pin 4*a* of each of the three support pieces 4 is rotatingly mounted.

The support pieces 4 are crank-like in form, the crank-arm resting against the front end face of the bearing member 2 and being situated behind a flange 3*a* projecting inwardly from the jacket portion of the bell-shaped control member 3. In the region of the flange 3*a*, each support piece 4 has a cheek 4*b* which, under the effect of an annular spring to be described below, rests against an associated section of the inner surface, taking the form of a control surface 18, of the flange 3*a* of the control member 3. A supporting journal 4*c* projects out forwardly from the cheek 4*b* of each support piece 4; and cantilevered on each journal 4*c*, the associated thread roller 5 is rotatingly mounted and secured against axial displacement by a circlip 19.

Figure 3:
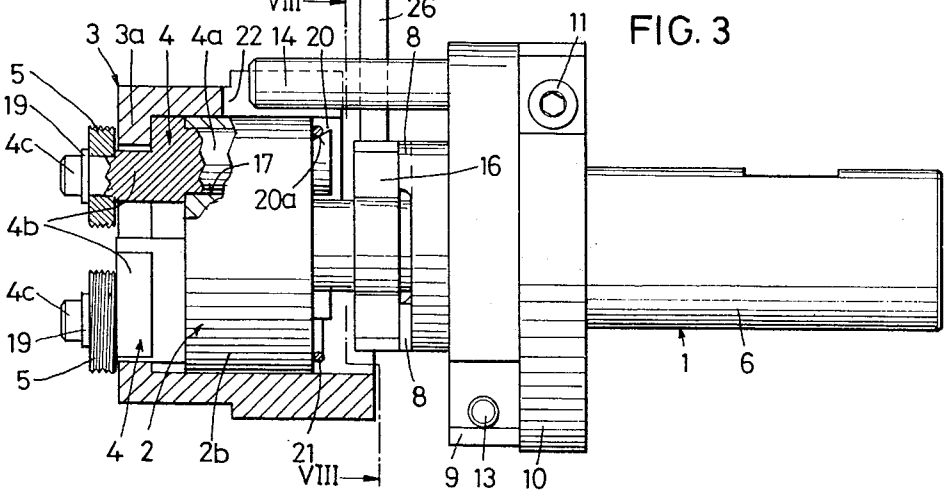
FIGS. 3 and 4 are an elevation, partially in section, and an end-on view, respectively, the parts being shown in the position they assume when the thread rollers are as far away as possible from the longitudinal axis of the thread-rolling head, i.e., when the thread-rolling head is "open,"
Figure 6:
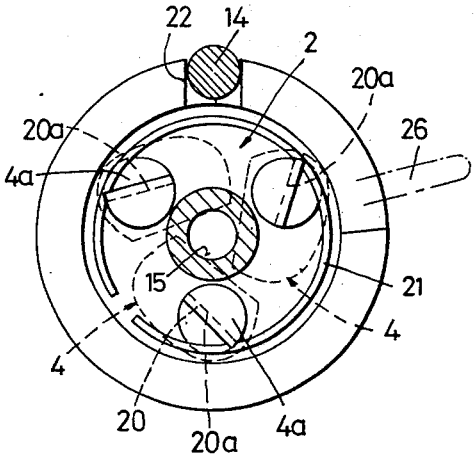
FIG. 6 is a section taken on the line VI—VI of FIG. 1, and FIGS. 7 and 8 are two similar cross-sections taken on the line VII—VII of FIG. 1 and on the line VIII—VIII of FIG. 2, respectively.

As may be seen particularly in FIGS. 1, 3 and 6, the end portion of each pivot pin 4*a*, projecting rearwardly out of the associated bearing bore 17, has a recess 20 which is segmentally shaped when viewed in axial direction, and the bottom 20*a* of which is rearwardly inclined at an angle of about 30° to the axis of the respective pivot pin. The above-mentioned annular spring 21 rests against the rearward end face of the head portion 2*b* of the bearing member 2 and presses at all times upon one end of each recess bottom 20*a* of all three support pieces 4, whereby the latter are prevented from being pushed forward out of the bearing member 2, and their cheeks 4*b* are simultaneously kept resting against the control surface 18 of the control member 3.

The jacket portion of the control member 3 is slidingly seated on the outer surface of the head portion 2*b* of the bearing member 2. In the rear part of this jacket portion is an elongated slot 22, into which the bolt 14 projects with practically no radial play, whereby the control member 3 is nonrotatingly but slidingly coupled with the first disc 9 of the support member 1. The adjusting device already described, comprising the parts 12 and 13, does, however, make possible a certain rotational adjustment of the control member 3 relative to the shaft 6 and the second disc 10 of the support member 1, and hence also a corresponding rotational adjustment of the operative sections of the control surface 18 with respect to the cheeks 4*b* of the support pieces 4, particularly when the latter assume their working position, i.e., when the claws 8 and 16 forming part of the stop means are engaged with one another, as shown in FIG. 7. By means of such a rotational adjustment, the effective diameter of the thread-rolling head, and thus the diameter of the thread produced on the workpiece, may be slightly varied.

A plug-like insert part 24 is tightly held in the extreme rear of the blind-end bore 7 of the shaft 6 by a headless screw 23. A spiral spring 25 is housed in the blind-end bore 7. The rearward end portion of the spring 25, extending radially, engages in a corresponding hole in the insert part 24, and the front end portion thereof, also extending radially, engages in a corresponding hole in the rearward end portion of the bearing-member shaft 2*a*. The spiral spring 25 acts simultaneously as a traction spring for retracting the bearing member 2 and as a torsion spring which tends to press the claws 16, formed on the bearing member 2, against the claws 8, formed on the support member 1, both in the axial and in the peripheral direction. Fastened in one of the claws 16 of the bearing member 2 is a clamping stud 26, which may, for example, be manually operated, and which makes it possible to turn the bearing member 2 back against the force of the spring 25 (in other words, to clamp the thread-rolling head) out of the rotational position shown in FIG. 8, where the clamping stud 26 rests against the bolt 14, into the rotational position in which the claws 8 and 16, as shown in FIG. 7, come into engagement with each other and in which, at the same time, the support pieces 4, acted upon the control surface 18, are pivoted towards the main axis of the thread-rolling head, thus yielding the working position of the thread rollers 5.

Figure 2:
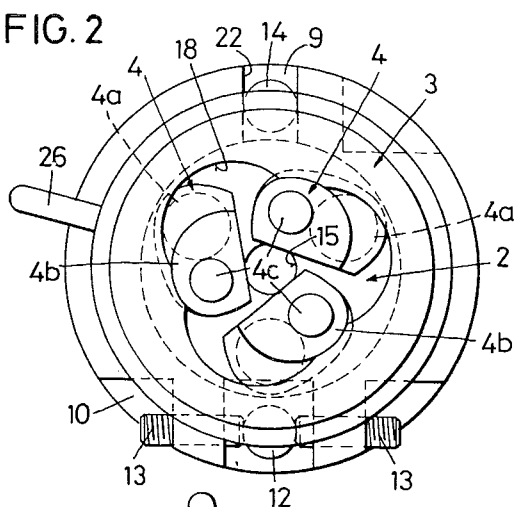
Figure 4:
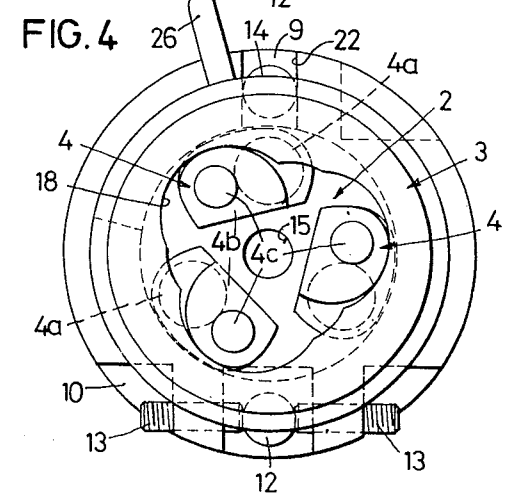
Figure 5:
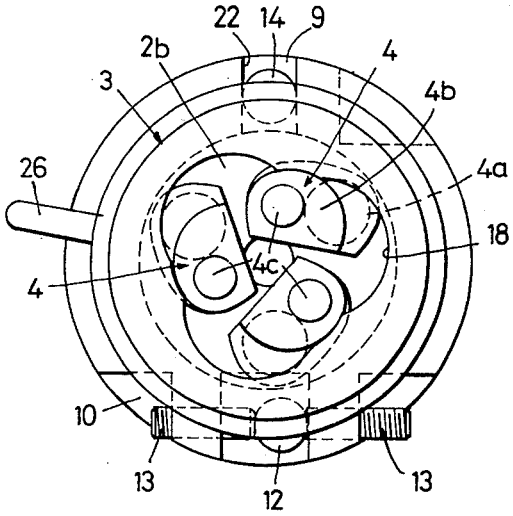
FIG. 5 is an end-on view similar to that of FIG. 2, but illustrating another setting of the control member with respect to the bearing member and certain support pieces bearing the thread rollers.

When the thread-rolling head described above is in use, it must, as is usual, undergo the customary longitudinal feed by the machine part carrying it. As soon as such a feed movement ceases, while the workpiece continues to rotate relative to the thread-rolling head, the workpiece, by means of its engagement with the thread rollers 5, causes a continuation of the axial movement of the latter together with the support pieces 4 and the bearing member 2, whereby the claws 16 are axially disengaged from the claws 8. All that is needed for that purpose is an axial displacement by the height of the claws 8, which height, in a reduction to practice, amounts to one or two millimeters, for example. As soon as the claws are disengaged from one another, i.e., as soon as the stop means which they constitute have become inoperative, the torque exerted by the workpiece on the bearing member 2 via the thread rollers 5 and the support pieces 4 can temporarily still, as during the thread-rolling operation, become operative and can aid the spring 25, which is very weak in itself, in its endeavour to rotate the bearing member 2 together with the support pieces 4 and the thread rollers 5 in such a way (from the position shown in FIG. 2 to that shown in FIG. 4) that as a result of the travel of the cheeks 4*b* of the support pieces 4 along the control surface 18 of the control member 3, the support pieces 4 are pivoted outwardly; this pivoting motion is completed by the annular spring 21, whereby the thread rollers 5 are lifted entirely off the workpiece radially, or in other words, the thread-rolling head is opened. As just described, this opening is initiated inevitably and without delay. After the thread-rolling head has opened, it can be withdrawn from the workpiece axially with the machine part carrying it.

A variety of changes might be made in the embodiment described without departing from the framework of the invention. Thus, for example, the support member might essentially take the form of a ring which could be mounted, possibly with the aid of screws parallel to the axis, on a turret-head forming part of a machine tool or on some other member undergoing the necessary feed movement. The bolt 14 might be secured directly to this ring or other main part of the support member, in which case the adjusting device 12, 13 would be omitted. A spiral spring corresponding to the spring 25 might then be accomodated in the longitudinal bore of the bearing member.

What is claimed is:

1. A thread-rolling head for processing a workpiece and comprising a support member, a bearing member held in front of said support member and having an axis in common therewith, three crank-like support pieces identical to one another and each having a pivot pin, a supporting journal, and a cheek, three bearing bores made in said bearing member and distributed about said common axis, each said pivot pin being situated in a respective said bearing bore, three thread rollers, each said thread roller being borne by a respective said supporting journal, a control member coaxially surrounding said bearing member and having an inner flange, the inner side of said flange forming a control surface, each said cheek resting against a respective section of said control surface, stop means disposed on said support member and on said bearing member, and a spring disposed within said support member, said control surface being so designed that a relative rotation between said bearing member and said control member causes a uniform pivoting of said support pieces away from one another and, said stop means being adapted either to engage with one another and thereby to prevent said relative rotation or to disengage from one another and thereby to enable said spring to bring about said relative rotation, wherein said control member is held unrotatingly on said support member whereas said bearing member is held rotatingly, said stop means being operative between said bearing member and said support member in such a way that during operation, said stop means transmit to said support member a torque transmitted from said workpiece to said bearing member via said thread rollers, a forward displacement of said bearing member relative to said support member caused by said workpiece rendering said stop means inoperative, and said torque, temporarily still acting upon said bearing member, aiding said spring in rotating said bearing member for enabling said pivoting of said support pieces away from one another.

2. A thread-rolling head in accordance with claim 1, further comprising three circlips, wherein said thread rollers are disposed in front of said inner flange on said supporting journals, said supporting journals being cantilevered, and said thread rollers being secured thereon against forward displacement by respective said circlips.

3. A thread-rolling head in accordance with claim 1, further comprising a single annular spring, wherein each said pivot pin comprises a recess in the rearward end of said pivot pin which projects out of said bearing member and said recess being segmentally shaped when viewed in axial direction and said annular spring acting upon said pivot pins in the region of said recesses for holding said cheeks against said control surface.

4. A thread-rolling head in accordance with claim 3, wherein each said recess has a bottom, each said bottom being rearwardly inclined at an angle of about 30° to the axis of the respective said pivot pin.

5. A thread-rolling head in accordance with claim 1, wherein said spring is a spiral spring, said support member comprises a support member shaft having an axial bore, and said bearing member comprises a bearing member shaft, a portion of said bearing member shaft being rotatingly and slidingly mounted in said axial bore, and said spiral spring being accommodated in said axial bore and exerting, besides its torsional effect, a traction effect upon said portion of said bearing member shaft.

6. A thread-rolling head in accordance with claim 5, wherein said support member comprises a front end face, and said stop means comprise claws formed partly on said front end face of said support member and partly on the periphery of said bearing member shaft.

7. A thread-rolling head in accordance with claim 6, further comprising a first disc, a bolt, a second disc, and an adjusting device, wherein said control member comprises an elongated slot and said support member shaft comprises an exterior flange at its front end, said first disc being basically rotatingly disposed on said support member shaft and lying against the rear side of said exterior flange, said bolt being eccentrically secured in said first disc, positioned parallel to the axis of said support member shaft, and adapted for engagement substantially without radial play in said elongated slot, said second disc being clamped fast on said support member shaft immediately behind said first disc, and said adjusting device being operative between said first disc, and said second disc for enabling a rotational adjustment of said first disc together with said control member.

* * * * *